US006695197B2

(12) United States Patent
Johansson

(10) Patent No.: US 6,695,197 B2
(45) Date of Patent: Feb. 24, 2004

(54) TACKER FOR BOTH NAIL AND STAPLES WITH A RESILIENT GUIDING DEVICE FOR THE NAIL AT THE LAUNCHING POSITION

(75) Inventor: Claes Johansson, Åsenhöga (SE)

(73) Assignee: Isaberg Raopid AB, Hestra (SE)

( * ) Notice: Subject to any disclaimer, the term of this patent is extended or adjusted under 35 U.S.C. 154(b) by 0 days.

(21) Appl. No.: 10/220,618

(22) PCT Filed: Feb. 16, 2001

(86) PCT No.: PCT/SE01/00332

§ 371 (c)(1),
(2), (4) Date: Sep. 4, 2002

(87) PCT Pub. No.: WO01/66313

PCT Pub. Date: Sep. 13, 2001

(65) Prior Publication Data

US 2003/0121949 A1 Jul. 3, 2003

(30) Foreign Application Priority Data

Mar. 8, 2000 (SE) ..... 0000760

(51) Int. Cl.[7] ..... B25C 5/10
(52) U.S. Cl. ..... 227/138; 227/119; 227/123
(58) Field of Search ..... 227/109, 119, 227/123, 138

(56) References Cited

U.S. PATENT DOCUMENTS

| | | | | |
|---|---|---|---|---|
| 3,633,811 A | | 1/1972 | Ploen | 227/109 |
| 5,632,431 A | * | 5/1997 | Lin | 227/109 |
| 5,653,371 A | * | 8/1997 | Hou | 227/109 |
| 5,695,108 A | * | 12/1997 | Lee | 227/109 |
| 5,727,726 A | * | 3/1998 | Lin | 227/119 |
| 5,791,547 A | * | 8/1998 | Yang | 227/120 |
| 5,816,469 A | * | 10/1998 | Ohuchi | 227/119 |
| 5,873,509 A | | 2/1999 | Liao | 227/109 |
| 6,398,097 B1 | * | 6/2002 | Liang | 227/109 |
| 6,502,737 B2 | * | 1/2003 | Akiba | 227/109 |

FOREIGN PATENT DOCUMENTS

| | | |
|---|---|---|
| SE | 506 725 | 2/1998 |

* cited by examiner

*Primary Examiner*—Rinaldi I. Rada
*Assistant Examiner*—Gloria R Weeks
(74) *Attorney, Agent, or Firm*—Miles & Stockbridge P.C.

(57) ABSTRACT

A tacker for driving fasteners (11) into an object (14), which optionally consist of U-shaped staples or nails, has a driver (13) which in an ejecting motion ejects a fastener (11) and drives it into the object (14). Catches (19*b*) are arranged to prevent a nail (11) fed to an ejecting position from tilting to an inclined position which significantly deviates from the direction of ejecting/driving in. The catches (19*b*) are movable between a first position in which they extend into the path of the ejecting motion of the driver (13), and a second position in which they are moved away from this path against spring action. Each catch (19*b*) is formed don a tongue (19) which is punched in a plate (18) and bent to L shape, one L leg (19*b*) of the tongue extending perpendicular to the plane of the plate and forming the catch and the other L leg (19*a*) being positioned in the plane of the plate and forming a part which in a resiliently yielding manner supports the catch. The perpendicular L leg (19*b*) of the tongue (19) has a ramp surface (19*c*) for cooperation with the driver (13) such that the catch is moved away against spring action to its second position directly or indirectly by the driver during the ejecting motion thereof.

14 Claims, 4 Drawing Sheets

TACKER FOR BOTH NAIL AND STAPLES WITH A RESILIENT GUIDING DEVICE FOR THE NAIL AT THE LAUNCHING POSITION

FIELD OF THE INVENTION

The present invention relates to a tacker for driving fasteners into an object, said tacker being optionally usable either for driving in fasteners in the form of essentially U-shaped staples or for driving in fasteners in the form of nails, said tacker having a driver which is adapted to eject, in an ejecting motion, a fastener fed to an ejecting position in the tacker and drive it into the object.

BACKGROUND ART

A tacker of this type can be used both for driving in staples and for driving in nails into an object. In the first case, the magazine of the tacker contains a row of staples, and in the second case its magazine contains a row of nails. The field of application of the tacker is changed by replacing the row of staples with a row of nails and vice versa.

A prior-art tacker of the type described above will now be described with reference to FIG. 1, which most schematically illustrates a portion of this tacker. The tacker has a magazine 1, which contains essentially U-shaped staples 2. The web portion or back of the staples 2 extends between the side walls 1*a* of the magazine 1, and their legs extend along the respective side walls 1*a*. The staples 2 are arranged side by side and are releasably connected to each other. The staples 2 are fed in their transverse direction along the magazine 1. The staple which in the feeding direction is the foremost staple and which is in the ejecting position, rests against a front plate 3. A driver (not shown), which has the form of a plate whose thickness is the same as the width of the staples 2, i.e. their extent in the feeding direction, is adapted to strike in its ejecting motion the web portion of the foremost staple 2 in order to release this staple from the others and eject it from the tacker.

When the tacker is to be used for driving in nails 4 instead of staples 2, the row of staples is replaced by a row of nails containing successively arranged nails 4, which are releasably connected to each other. The row of nails is positioned close to one magazine wall 1*a*. The nails 4 are fed in the same manner as the staples 2 along the magazine 1.

For reasons of illustration, FIG. 1 shows both staples 2 and nails 4, but it will be appreciated that the tacker contains either staples 2 or nails 4.

The nails 4 have in the shown example a somewhat greater width than the staples 2. The nail 4 which is the foremost nail in the feeding direction and which is in the ejecting position, is inserted into a groove 5 formed in the front plate 3 and rests against the bottom of the groove. In this position, the back of the foremost nail 4 is on a level with or slightly behind the plane in which the back of the foremost staple 2 is located when the staple rests against the front plate 3. In this position, the groove 5 prevents the nail 4 from tilting laterally towards the centre of the magazine 1. The magazine wall 1*a* prevents lateral tilting in the opposite direction. The driver strikes in its ejecting motion the head of the foremost nail 4 in order to release this nail from the others and eject it from the tacker.

Another prior-art tacker of the type stated by way of introduction will now be described with reference to FIG. 2 which most schematically shows a portion of this tacker. Equivalent components in FIGS. 1 and 2 have the same reference numerals. The tacker according to FIG. 2 differs from the tacker shown in FIG. 1 on the one hand by being intended for wider staples 2 which in this case are of the same width as the nails 4 and, on the other hand, by the front plate 3 not having the groove 5. If the tacker according to FIG. 2 had such a groove, the back of the foremost nail 4 abutting against the bottom of the groove and, thus, also the front of the next nail would be located in front of the plane in which the back of the foremost staple 2 is located when the staple rests against the front plate 3. This would mean that also the next nail would be struck by the driver, whose thickness is here the same as the width of the wider staple 2. Of course, this would cause a fault in the tacker. A problem of the tacker shown in FIG. 2 is that the nail 4 in the ejecting position, especially when it is the last nail in the row of nails in the magazine 1, may tilt laterally towards the centre of the magazine 1.

SUMMARY OF THE INVENTION

The object of the present invention is to provide a tacker, in which this problem is obviated.

According to the present invention, this object is achieved with a tacker, which is of the type stated by way of introduction and further has at least one catch, which is adapted to prevent a nail fed to the ejecting position from tilting to an inclined position, which significantly deviates from the direction of ejecting/driving in, and which is movable between a first position, in which it extends into the path of the ejecting motion of the driver, and a second position, in which it is moved away from this path against spring action, said tacker being characterised in that each catch is formed on a tongue which is bent to L shape and punched in a first plate and whose one L leg extends perpendicular to the plane of the plate and forms the catch and whose other L leg is positioned in the plane of the plate and forms a part supporting the catch in a resiliently yielding manner, said one L leg of the tongue having a ramp surface for such cooperation with the driver that the catch is moved away against spring action to its second position by the driver during the ejecting motion thereof when the tacker is used for driving in nails, and by the web portion of a staple that is being ejected when the tacker is used for driving in essentially U-shaped staples.

The tacker preferably has two essentially identical, separate catches which are successively arranged in the ejecting direction of the driver.

The first plate suitably is a piece of sheet metal.

A second plate is preferably arranged as a front support for the fastener which is located in the ejecting position, the first plate engaging the side of the second plate facing away from the fastener, and each catch extending into the path of the ejecting motion of the driver via a hole in the second plate. The second plate suitably is a piece of sheet metal.

BRIEF DESCRIPTION OF THE DRAWINGS

The invention will now be described in more detail with reference to the accompanying drawings.

DESCRIPTION OF A PREFERRED EMBODIMENT

Figure 1:
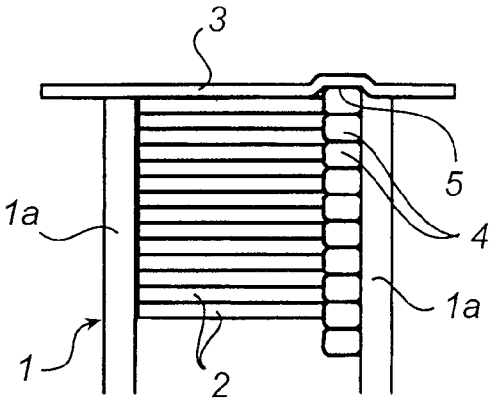
Fig. 1 PRIOR ART
FIG. 1 is a schematic view and shows a portion of the first prior-art tacker described above.
Figure 2:
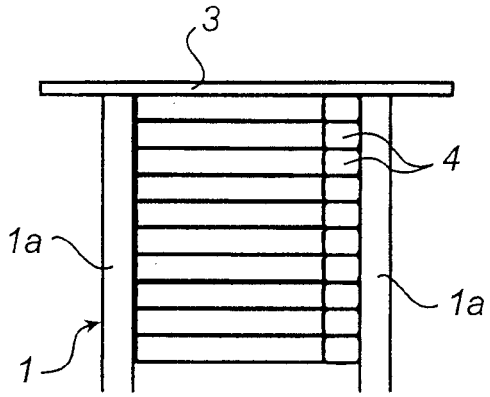
Fig. 2 PRIOR ART
FIG. 2 is a schematic view and shows a portion of the second prior-art tacker described above.
Figure 3:
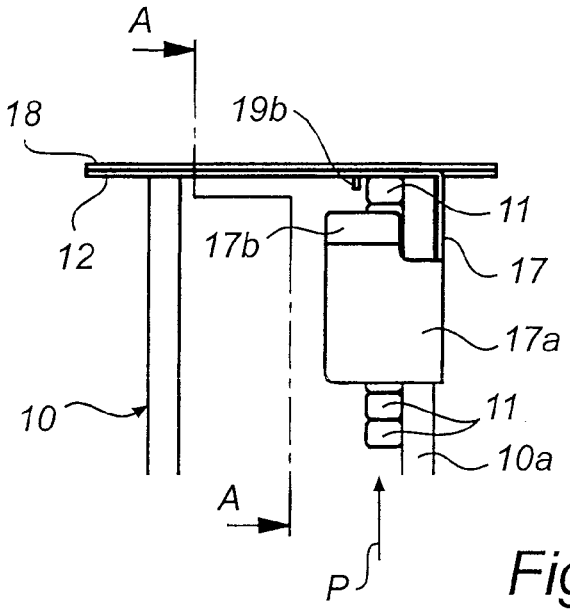
FIG. 3 is a schematic view and shows a portion of a tacker according to the invention.
Figure 6:
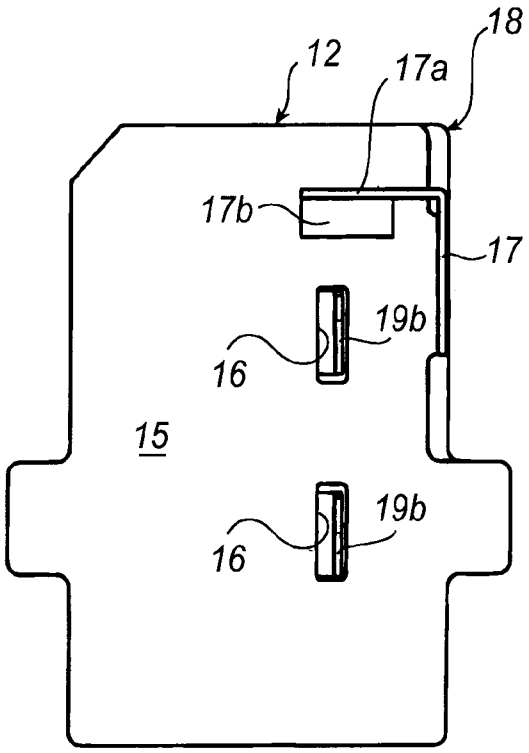
FIG. 6 is a top plan view and shows the two pieces of sheet metal in the assembled position.
Figure 5:
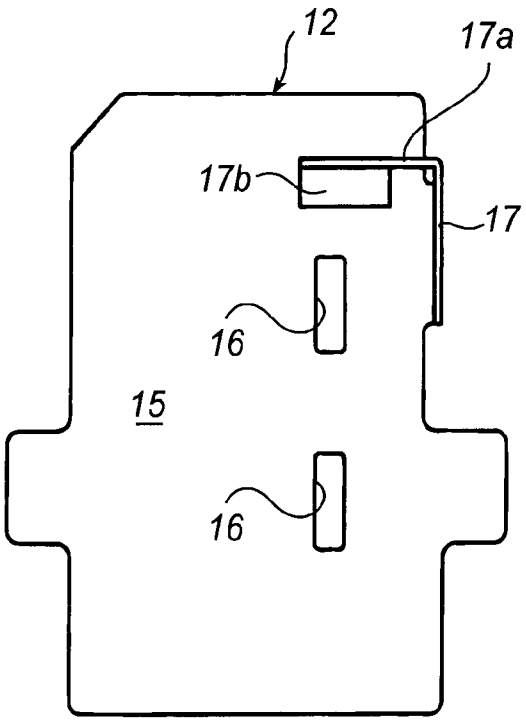
FIG. 5 is a top plan view and shows a second piece of sheet metal in the tacker according to FIG. 3.

The tacker illustrated in FIG. 3 is shown when used for driving in nails. In the same manner as the prior-art tackers described above, the tacker can also be used for driving in essentially U-shaped staples. The field of application of the tacker is changed in the same way as in these prior-art tackers.

The tacker has a magazine 10, which contains a row of nails 11 which are arranged side by side and are releasably connected to each other. The row of nails is positioned close to one side wall 10*a* of the magazine 10. The nails 11 are fed in prior-art manner in the direction of arrow P in FIG. 3. The foremost nail 11 seen in the feeding direction engages a front support 12 and is located in an ejecting position, in which it is ejected, by means of a driver 13 (see FIGS. 10–12), from the tacker so as to be driven into an object 14. The driver 13 consists of an essentially rectangular plate whose thickness is equal to the width of the nails 11. The nails 11 have in turn the same width as the staples for which the tacker is intended.

The front support 12 is made of a piece of sheet metal, which has a substantially rectangular, plane part 15 with two essentially rectangular holes 16 which are aligned with each other and successively arranged in the ejecting direction of the driver 13. The front support 12 also has a flange 17 extending towards the row of nails and parallel with the magazine wall 10*a*. The flange 17 has an inwardly perpendicularly bent portion 17*a* which extends from the free end of the flange 17 towards the plane part 15 but terminates at some distance therefrom. This distance is somewhat greater than the width of the individual nails 11 (see FIGS. 3 and 10–12) and thus allows the driver 13 to pass freely between the plane part 15 of the front support 12 and the inwardly bent portion 17*a* of the flange 17. This portion 17*a* is perpendicularly bent to an L shape in its front part 17*b*, which forms a "nail roof" which ensures that the nail closest to the nail in the ejecting position is kept in place and, for example, does not accompany the driver 13 in its motion in the direction opposite to the ejecting direction.

Figure 4:
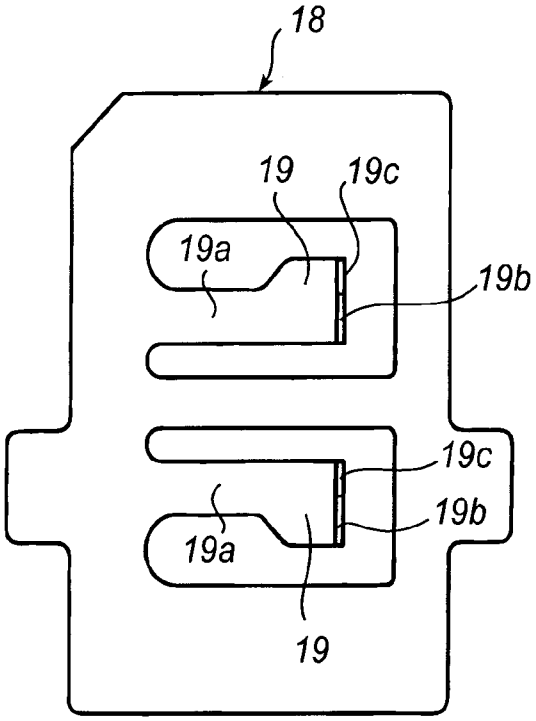
FIG. 4 is a top plan view and shows a first piece of sheet metal in the tacker according to FIG. 3.
Figure 8:
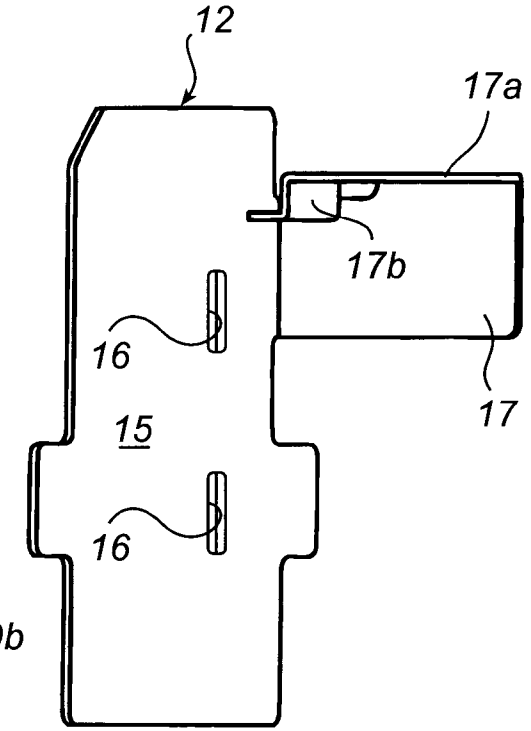
FIG. 8 shows the second piece of sheet metal in perspective.
Figure 7:
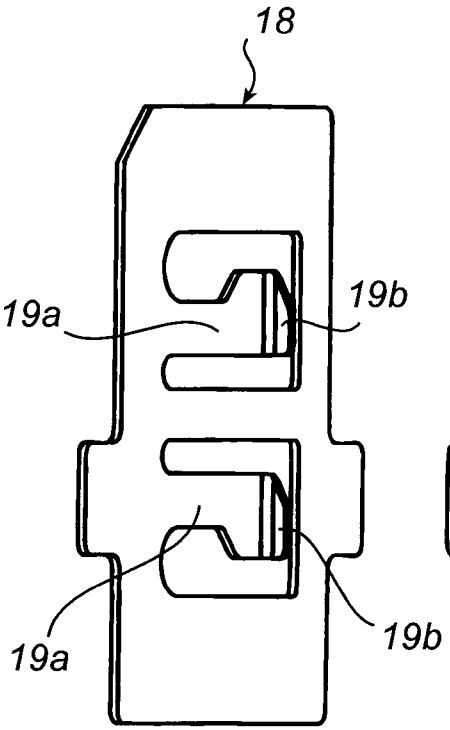
FIG. 7 shows the first piece of sheet metal in perspective.
Figure 9:
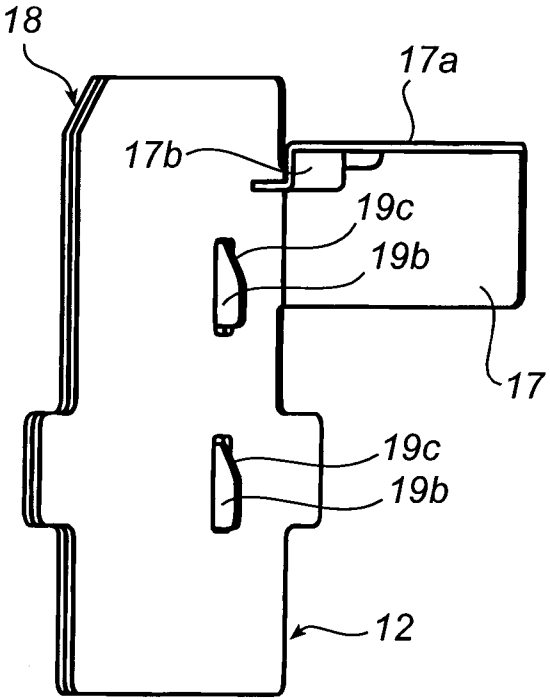
FIG. 9 shows the assembled pieces of sheet metal in perspective.

FIG. 4 shows a piece of sheet metal 18 which has the same dimensions as the plane part 15 of the front support 12. The piece of sheet metal 18 has two punched tongues 19 which are bent to L shape and have an L leg 19*a* parallel with the piece of sheet metal 18 and a considerably shorter L leg 19*b* extending perpendicular to the L leg 19*a*. Each L leg 19*b* has a ramp surface 19*c*.

The piece of sheet metal 18 engages the side of the front support 12 facing away from the nails 11, the L legs 19*b* of the tongues 19 extending each through a hole 16 in the plane part 15 of the front support 12 and projecting a distance from the plane part 15 in order to extend into the path of the ejecting motion of the driver 13. The holes 16 and the L legs 19*b* are arranged in such manner that the L legs 19*b* in their first position extending into the path of the ejecting motion of the driver 13 are located a short distance inside the nail 11 which is the foremost nail, i.e. in the ejecting position (see FIG. 3). The L legs 19*b* form a catch, which prevents the nail 11 fed to the ejecting position, and especially when this is the last nail in the row of nails, from tilting to an inclined position which significantly deviates from the direction of ejecting/driving in. The L legs 19*b* are, against the spring action caused by the respective L legs 19*a*, movable from the first position to a second position, in which they are moved away from the path of the ejecting motion of the driver 13.

Figure 12:
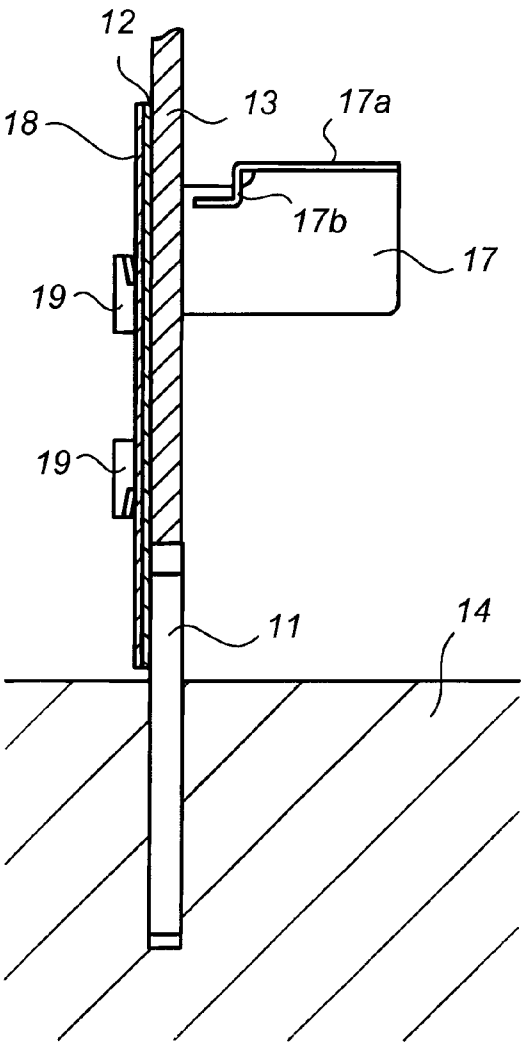
FIGS. 10–12 are sectional views along line A—A in FIG. 3 and show the tacker in different positions when ejecting and driving in a nail.
Figure 11:
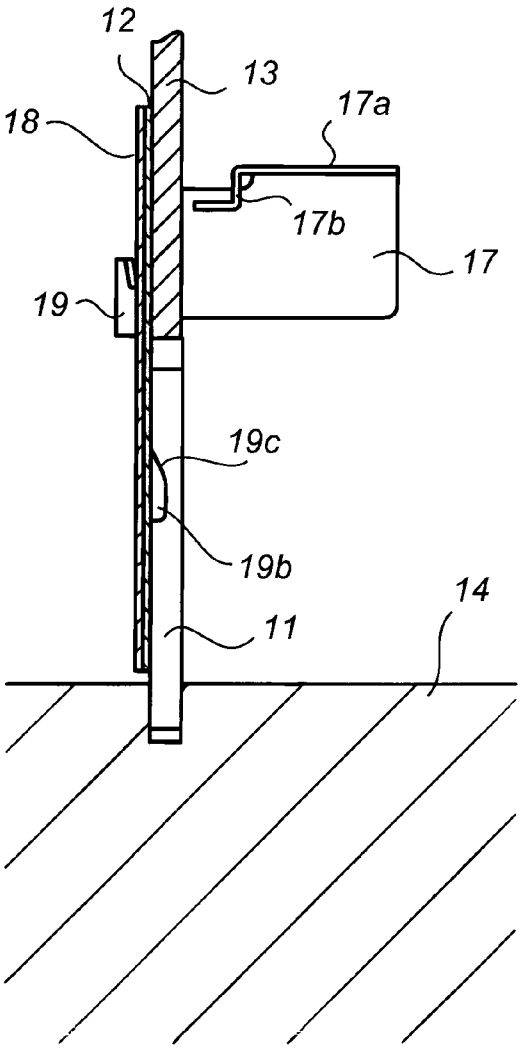
Figure 10:
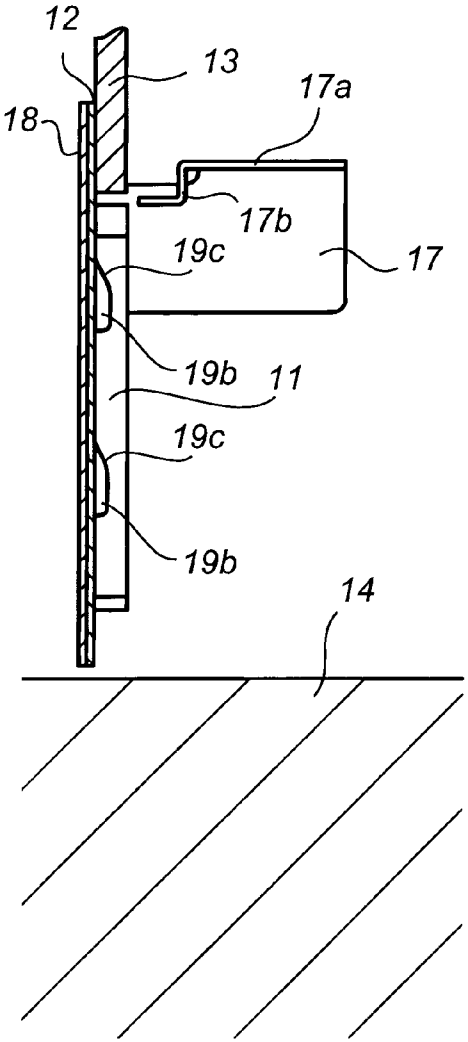

When the nail 11 which is in the ejecting position is to be ejected from the tacker and driven into the object 14 (see FIGS. 10–12), the driver 13 is given an ejecting motion, whereby it strikes the head of the nail 11 and ejects the nail in the manner shown in FIGS. 10–12. When the driver 13 reaches the L leg 19*b* of the first tongue 19, it strikes the ramp surface 19*c* thereof and moves, during its continued ejecting motion, this L leg 19*b* away to its second position. When the driver 13 reaches the L leg 19*b* of the second tongue 19, it moves in the same way this L leg to its second position. When the driver 13 is returned to its starting position, the L legs 19*b* are moved, by the spring action of the L legs 19*a*, back to their first position.

It may be noted that the L legs 19*b* are moved away in the same manner when the tacker is used for driving in essentially U-shaped staples. However, they are not moved away by the driver 13 direct but by the web portion of the tacker which is being ejected. It will be appreciated that the L legs 19*b* which serve as a catch for nails do not have any function when the tacker is used for driving in staples. Since the L legs 19*b* can be easily moved away in the manner described above, they constitute no bar when driving in the staples.

What is claimed is:

1. A tacker for driving fasteners into an object, said tacker being so constructed and arranged to drive in fasteners of a U-shaped staple type and of a nail type, said tacker comprising:

a driver which is so constructed and arranged to move along an ejecting direction between a starting position and a finishing position to eject a fastener fed to an ejecting position and to drive said fastener into an object;

a magazine having at least one side wall, said magazine being adapted to deliver fasteners to said ejecting position;

a first plate having at least one essentially planar surface, said first plate being positioned such that said essentially planar surface is adjacent to and parallel to said driver when said driver is in its finishing position;

a catch protruding from a plane of said essentially planar surface of said first plate in a direction toward a movement path of said driver, said catch being secured to said first plate via a tongue disposed substantially in a plane of said first plate, said tongue having a first end secured to said plate and second end having said catch protruding therefrom, said catch being positioned relative to said fastener ejecting position and said side wall of said magazine such that said catch and said side wall are disposed on diametrically opposed sides of a fastener fed to said ejecting position whereby said catch is operable to prevent a nail-type fastener from tilting to an inclined position which significantly deviates from a desired direction of ejection and driving of said nail-type fastener;

said catch further having an inclined ramp surface so constructed and arranged to engage said driver or a fastener being driven by said driver whereby, upon force being applied to said ramp surface said catch will be moved from a protruding position to a retracted position.

2. A tacker as claimed in claim 1, wherein said tongue is formed integrally with said first plate by providing an opening in said first plate with said tongue extending into said opening from an edge of said opening.

3. A tacker as claimed in claim 1, wherein said plate has at least two separate essentially identical catches which are positioned in succession along said ejecting direction of said driver.

4. A tacker as claimed in claim 1, wherein said first plate is constructed of sheet metal.

5. A tacker as claimed in claim 1, further comprising a second plate so constructed and arranged to operate as a front support for a fastener positioned at said ejecting position, and said essentially planar surface of said first plate engages a surface of said second plate that faces away from said fastener ejecting position, and wherein said second plate contains an opening through which said catch protrudes into the movement path of said driver.

6. A tacker as claimed in claim 5, wherein said second plate is constructed of sheet metal.

7. A tacker as claimed in claim 5, wherein said tongue is formed integrally with said first plate by providing an opening in said first plate with said tongue extending into said opening from an edge of said opening.

8. A tacker for driving fasteners into an object, said tacker being so constructed and arranged to drive in fasteners of a U-shaped staple type and of a nail type, said tacker comprising:

a driver which is so constructed and arranged to move along an ejecting direction between a starting position and a finishing position to eject a fastener fed to an ejecting position, and to drive said fastener into an object;

a first plate having at least one essentially planar surface, said first plate being positioned such that said essentially planar surface is adjacent to said driver when said driver is moved to said finishing position;

a catch protruding from said essentially planar surface of said first plate, said catch being supported in position by a tongue disposed within a cutout section of said first plate, said tongue having one end secured to said first plate, and having said catch disposed at a free end of said tongue, said tongue and said catch forming a substantially L-shaped member, wherein said catch protrudes outwardly from said planar surface of said first plate, and wherein said catch has an inclined ramp surface so constructed and arranged to come into contact with said driver or a staple-type fastener being driven by said driver as said driver moves along said ejecting direction from said starting position to said finishing position, such that the driver is capable of exerting force on said ramp surface to move said catch from a first protruding position to a second retracted position, and wherein said tongue operates to exert a spring action to return said catch to said protruding position when said driver returns to its starting position, said catch further being positioned in said tacker such that said catch and a side wall of a magazine disposed in said tacker straddle a nail-type fastener fed to an ejecting position, said catch thereby preventing the nail-type fastener from tilting to an inclined position which significantly deviates from a desired direction of ejection and driving of said nail-type fastener.

9. A tacker as claimed in claim 8, wherein said tongue is formed integrally with said first plate, and extends into said opening from an edge of said opening.

10. A tacker as claimed in claim 8, wherein said plate has at least two separate essentially identical catches which are positioned in succession along said ejecting direction of said driver.

11. A tacker as claimed in claim 8, wherein said first plate is constructed of sheet metal.

12. A tacker as claimed in claim 8, further comprising a second plate so constructed and arranged to operate as a front support for a fastener positioned at said ejecting position, and said essentially planar surface of said first plate engages a surface of said second plate facing away from said fastener ejecting position, and wherein said second plate contains an opening through which said catch protrudes into a path of said driver as said driver moves along said ejecting direction.

13. A tacker as claimed in claim 12, wherein said second plate is constructed of sheet metal.

14. A tacker as claimed in claim 12, wherein said tongue is formed integrally with said first plate, and extends into said opening from an edge of said opening.

* * * * *

UNITED STATES PATENT AND TRADEMARK OFFICE

CERTIFICATE OF CORRECTION

PATENT NO. : 6,695,197 B2
DATED : February 24, 2004
INVENTOR(S) : Claes Johansson It is certified that error appears in the above-identified patent and that said Letters Patent is hereby corrected as shown below:

Title page,
Item [73], Assignee, should read -- Isaberg Rapid AB, Hestra (SE) --.

Signed and Sealed this

Twenty-second Day of June, 2004

JON W. DUDAS
*Acting Director of the United States Patent and Trademark Office*